United States Patent [19]

Ambasz

[11] Patent Number: 4,580,919

[45] Date of Patent: Apr. 8, 1986

[54] FLEXIBLE PEN WITH SLIDING SLEEVE

[76] Inventor: Emilio Ambasz, 295 Central Park West, New York, N.Y. 10024

[21] Appl. No.: 704,709

[22] Filed: Feb. 25, 1985

[51] Int. Cl.[4] ..... B43K 9/00; B43K 7/00

[52] U.S. Cl. ..... 401/117; 401/88; 401/131; 401/209; 401/214; 24/11 R; 24/11 F

[58] Field of Search ..... 401/117, 214, 209, 91

[56] References Cited

U.S. PATENT DOCUMENTS

| | | | |
|---|---|---|---|
| 2,435,185 | 1/1948 | Reynolds | 401/117 |
| 3,079,895 | 3/1963 | Gordon | 401/117 X |

FOREIGN PATENT DOCUMENTS

| | | | |
|---|---|---|---|
| 193273 | 11/1957 | Austria | 401/214 |
| 2251428 | 4/1974 | Fed. Rep. of Germany | 401/209 |
| 373981 | 1/1964 | Switzerland | 401/209 |

*Primary Examiner*—Steven A. Bratlie

*Attorney, Agent, or Firm*—Brumbaugh, Graves, Donohue & Raymond

[57] ABSTRACT

A pen comprises an elongated one-piece barrel having substantially rigid tip end and head end portions joined to each other by an intermediate integral flexible portion, whereby the barrel can be bent at the flexible portion, and a writing tip at the distal end of the tip end portion. A substantially rigid tubular cap member is telescopically received over the tip end portion of the barrel such that it can be moved along the barrel between (1) a retracted position in which it overlies part of the tip end portion and substantially all of the flexible portion, thus exposing the writing tip for use and rendering the pen substantially rigid, and (2) an extended position in which it covers the writing tip and leaves the flexible portion exposed, thus protecting the writing tip and rendering the pen flexible. Interengaging rib and groove couplings on the cap and the tip end portion of the barrel releasably retain the cap member in each of the retracted and extended positions.

11 Claims, 7 Drawing Figures

FLEXIBLE PEN WITH SLIDING SLEEVE

BACKGROUND OF THE INVENTION

Nearly everyone uses a ball-point pen just about every day. Ball-point pens come in a variety of types, shapes and sizes and range in cost from a little as a few cents to several hundred dollars. The present invention relates to an inexpensive ball-point pen.

Relatively low cost ball-point pens can be found in both the retractable type, in which the writing tip extends from and retracts into a barrel, for example, by pressing in a push button at the head end of the barrel or by rotating one portion of the barrel relative to another portion, and the fixed type, some of which have removable caps, in which the writing tip is permanently fastened to the barrel. Generally, the retractable types are somewhat more costly to produce and, therefore, more expensive than the fixed types. The retractable types are generally preferable from the point of view of being transportable in a pocket or purse; the detachable caps of ball-point pens tend to get lost. Moreover, the barrel of a pen with a detachable cap can easily become detached from the cap when the pen is carried in a pocket or purse, in which case a shirt can be ruined or items in a pocketbook or coat pocket defaced.

Ball-point pens, and for that matter all writing instruments, are not particularly convenient to carry, but most people like to carry a pen anyway. When clipped to a shirt pocket or coat pocket, a pen can poke or press against the wearer from time to time. Some pockets are not deep enough to fully accept the pen. There is often not enough room in small compartments of purses or in small change purses to receive the conventional ball-point pen.

SUMMARY OF THE INVENTION

There is provided, in accordance with the present invention, a ball-point that is, in a sense, of the retractable type, in that the writing tip is exposed in one configuration and covered and protected in another configuration. In another sense, it is not a retractable type, inasmuch as there is no retraction mechanism for moving the writing tip into and out of the barrel, the writing tip being affixed to the barrel. The invention further provides a pen that is flexible when in the configuration in which the writing tip is covered and protected but is rigid when the tip is uncovered for use. The flexibility of the pen in the configuration when the tip is covered and protected allows the pen to bend when placed in a pocket or a purse so that it can fit conveniently into small pockets and purses and so that it can yield and thereby be more comfortable when carried on the person.

In particular the invention is a pen comprising an elongated one-piece barrel having substantially rigid tip end and head end portions joined to each other by an intermediate integral flexible portion, whereby the barrel can be bent at the flexible portion, and a writing tip at the distal end of the tip end portion. A substantially rigid tubular cap member is telescopically received over the tip end portion of the barrel in a manner such that it can be moved along the barrel between (1) a retracted position in which it overlies part of the tip end portion and substantially all of the flexible portion, and thus rendering the pen substantially rigid, and (2) an extended position in which it covers the writing tip and leaves the flexible portion exposed, thus protecting the writing tip and rendering the pen flexible. The cap and barrel have interengaging elements that releasably retain the cap member in each of the retracted and extended positions.

The invention may include the following additional characteristics, separately or in combination:

(1) The cap member has a length such that it covers a major part of the barrel when in the retracted position, the pen being thereby adapted to be held for use by gripping the cap member;

(2) An external circumferential surface of the tip end portion of the barrel closely adjacent the writing tip engages a matching internal surface of the cap member in the retracted position of the cap member, whereby the tip end portion is firmly supported within the cap member when the pen is in use;

(3) The cap member is retained in the respective extended and retracted positions by longitudinally spaced-apart external circumferential grooves in the tip end portion of the barrel that receive an internal circumferential rib on the cap member;

(4) The characteristic referred to in (3) above may be enhanced by providing on the groove in the barrel nearer the writing tip a retaining shoulder that engages the rib on the cap member, whereby detachment of the cap member from the barrel is impeded;

(5) A substantial part of the external surface of the tip end portion of the barrel between the grooves makes a sliding or clearance fit with the rib on the cap member, whereby the cap member slides easily between the extended and retracted positions;

(6) The end of the cap member nearer to the head end portion telescopically receives a part of the head end portion in the retracted position; and (6) The end of the cap member nearer to the head end portion telescopically receives a part of the head end portion in the retracted position; and (7) The head end portion of the barrel includes an integral pocket clip. In a preferred form the pocket clip is joined to the head end portion by an integral flexible hinge strip spaced apart from both ends of the clip, whereby the hinge strip constitutes a fulcrum. The distal end of the head end portion of the barrel receives a resilient insert having a portion engaging the pocket clip and resiliently urging the clip to pivot about the fulcrum, the insert being yieldable to enable the clip to pivot about the fulcrum to an open position.

(8) The flexible portion of the barrel comprises at least one bendable strip extending longitudinally between and joined to the tip end and head end portions and a multiplicity of longitudinal spaced-apart ribs extending transversely from the strip at least in each direction of bending of the strip, the adjacent pairs of ribs being engageable upon bending of the strip and limiting the amount of bending of each segment of the strip between adjacent ribs.

The main advantages of a pen, embodying the present invention are the ability to be bent, which facilitates carrying the pen on the persion or in small purses, and the capability of covering the tip when the pen is transported by a cap that is non-detachable and cannot, therefore, get lost. In a preferred embodiment, the pocket clip has to be opened up manually like a clothespin, which prevents the wear of a shirt or coat pocket that occurs with conventional pocket clips.

For a better understanding of the invention, reference may be made to the following description of an exemplary embodiment, taken in conjunction with the figures of the accompanying drawings.

DESCRIPTION OF THE EMBODIMENT

Figure 1:
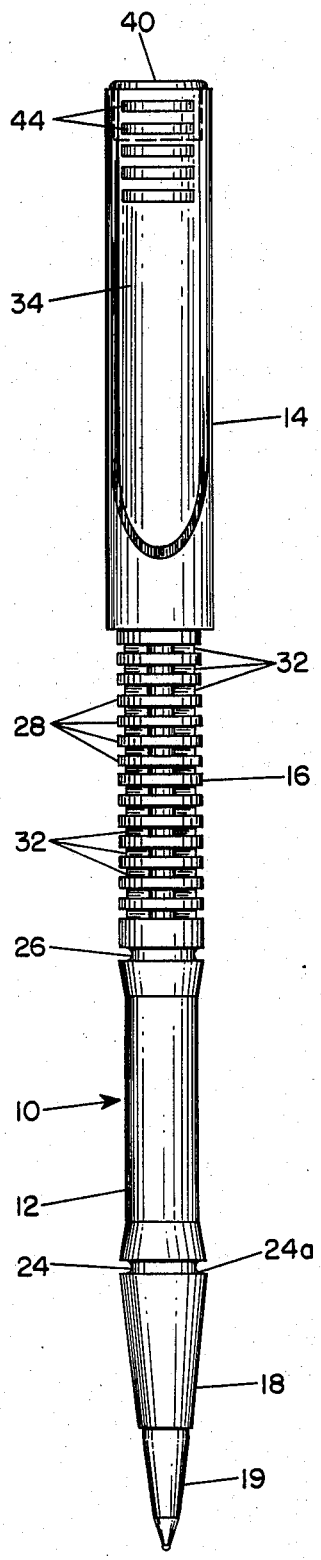
FIG. 1 is a front elevational view of the barrel component.
Figure 2:
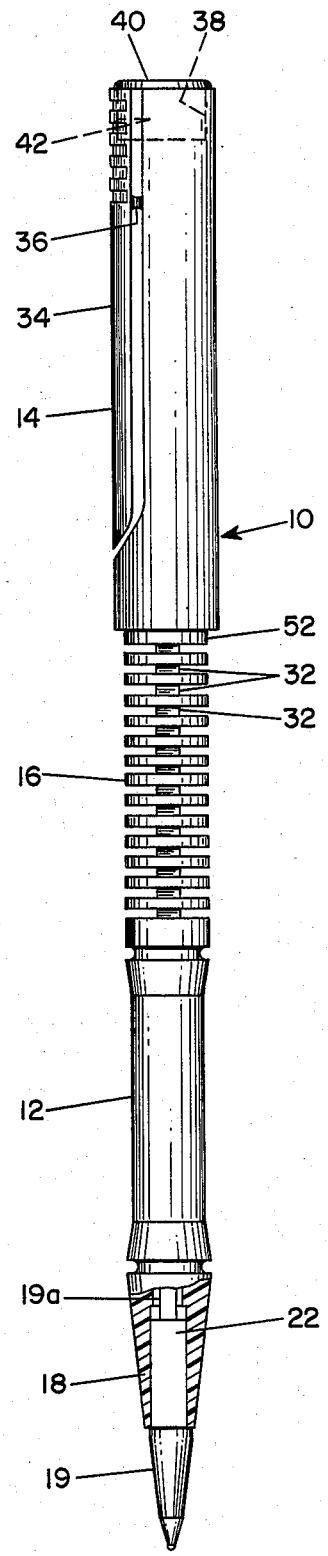
FIG. 2 is a side elevational view of the barrel component, a portion being broken away in cross section.
Figure 5:
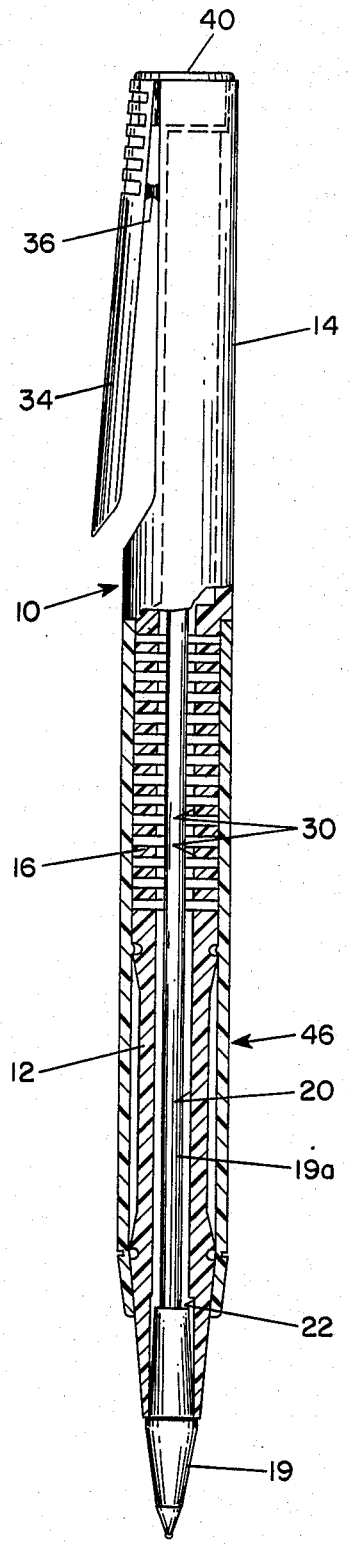
FIG. 5 is a side cross-sectional view of the embodiment as assembled and shows the cap member in the retracted position and the pocket clip opened up.

The barrel 10 (FIGS. 1 and 2) is an elongated one-piece member made of a suitable plastic, such as a substantially rigid nylon, by injection molding. It comprises three main sections, a rigid tip end portion 12, a rigid head end portin 14, and an intermediate integral flexible portion 16 joining the tip end and head end portions. The tip end portion 12 is rotationally symmetrical about its longitudinal axis and includes at its distal end a tapered external surface 18 that generally matches the taper of a writing tip 19 of the pen. An internal hole 20 extends (see FIG. 5) co-axially with the axis of the barrel the entire length of the tip end portion 12, the hole having an enlarged portion at the distal end defining a shoulder 22 against which the shank of the writing tip 19 bears. The hole 20 accepts the tubular ink reservoir 19*a* of a ball-point cartridge, which may be of any suitable construction but preferably has a flexible plastic casing that extends the entire length of the barrel. A short, rigid ink reservoir that does not extend into the flexible portion of the barrel is also suitable.

The tip end portion 12 has a pair of longitudinally spaced-apart, circumferentially extending grooves 24 and 26, A shoulder 24*a* defining the wall of the groove 24 nearer the distal end of the tip end portion 12 is of a slightly greater height than the other wall, for a reason that is described below. Over a major part of the space between the grooves 24 and 26, the outer surface of the tip end portion 12 has a diameter that is slightly less than the diameters at the respective junctures with the grooves.

The flexible portion 16 comprises a multiplicity of circular ribs 28, each of which has a central hole 30 of the same diameter as the hole 20 and, therefore, is able to receive the flexible ink reservoir of the writing tip cartridge. The adjacent ribs are joined to each other, and the endmost ribs are joined to the respective portions 12 and 14, by diametrically-opposite connecting portions 32, the connecting portions being aligned in two rows in the longitudinal direction and being located adjacent the perimeter. The connecting portions 32 define relatively thin lengthwise strips or bands joining the tip end head end portions. These thin bands can bend back and forth in a direction that is widthwise to the two rows, i.e., in the plane of the paper with respect to FIG. 1 and perpendicular to the plane of the paper with respect to FIG. 2. The ribs 28, in addition to serving an aesthetic purpose in that they provide visual mass to what would otherwise be a thin ribbon or ribbons joining two end portions, restrict and control the flexure of the flexible portion by engaging under extreme flexure; each pair of ribs limits the amount of bending that can occur in the connecting portion between them. The rings also join the two strips to each other transversely and stiffen them so they do not bend in the direction of the joinder.

Figure 4B:
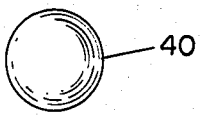
FIGS. 4A and 4B are a side elevational view and a top plan view, respectively, of an insert that closes the head end of the barrel.
Figure 4A:
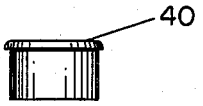
Figure 6:
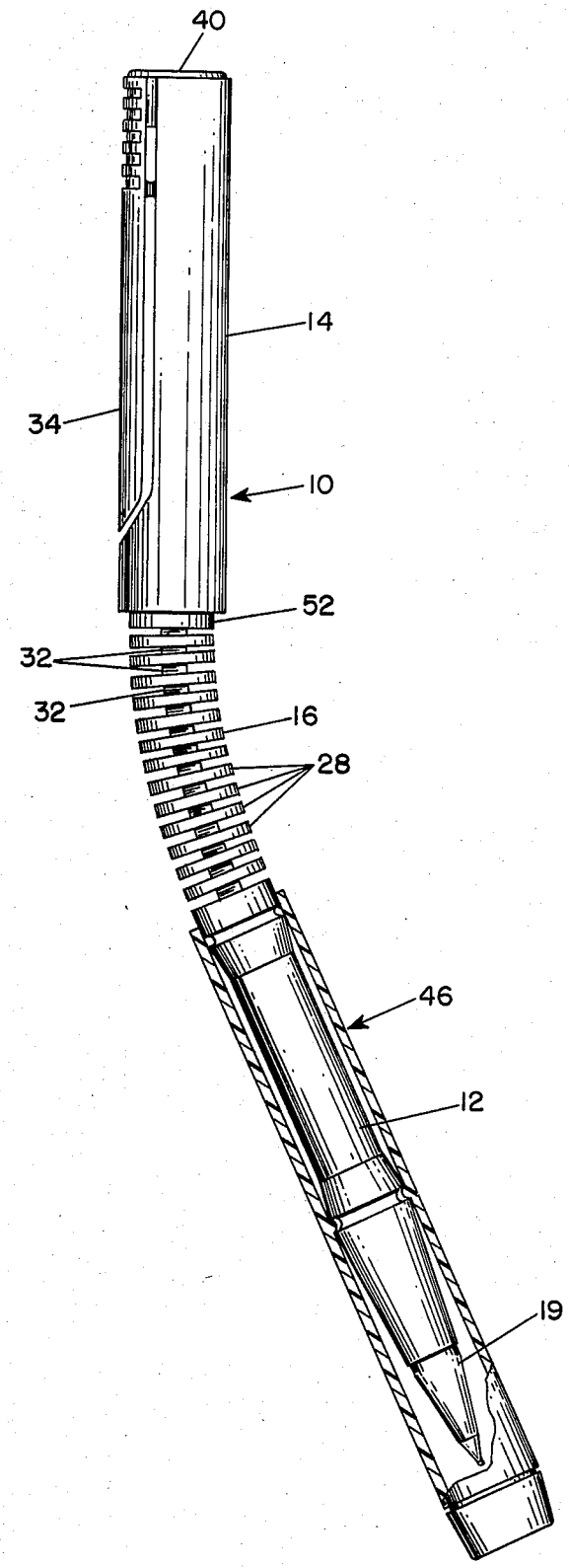
FIG. 6 is a side elevational view of the embodiment as assembled, the cap member being shown in cross section in the extended position, and illustrates how the barrel bends.

The head end portion 14 is tubular (to minimize the use of material), and has a circular cylindrical external surface. A pocket clip 34 is formed integrally with the body and is joined to the body by a hinge strip 36 that defines a fulcrum about which the clip 34 can pivot. A cavity 38 in the distal end of the head end portion 14 receives a resiliently deformable insert 40 (see FIGS. 4A and 4B), that is accepted by and engages a notch 42 in the under surface of the pocket clip. A series of shallow grooves 44 in the pocket clip portion 34 facilitate gripping the distal end of the pocket clip so that the user can squeeze the pocket clip to an open position (see FIG. 5) to open up the clip so the pen can be stuck in a pocket. The resilient insert 40 urges the pocket clip to the closed position (see FIG. 6).

Figure 3:
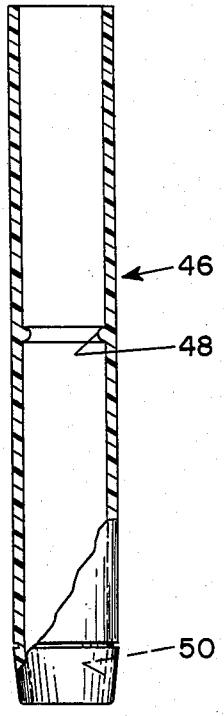
FIG. 3 is an axial cross-sectional view of the cap member, a portion being shown in elevation.

The cap member 46 (see FIG. 3) is rotationally symmetrical about a lengthwise central axis. It is tubular and telescopically receives the tip end portion 12 and the flexible portion 16 of the barrel in either of two positions, each of the positions being established and maintained against a selected level of axial force by reception of an internal rib 48 in one or the other of the grooves 24 and 26 on the tip end portion of the barrel. When the rib 48 is seated in the groove 24, the cap 46 is extended and covers and protects the writing tip of the pen (see FIG. 6). When the rib 48 is received in the groove 26, the cap member overlies the major part of the tip end portion 12 and all of the resilient portion 16 of the barrel. In this retracted position, the writing tip of the pen (see FIG. 5) is uncovered, the internal surface 50 on the tip end of the cap member engages part of the tapered surface 18 of the tip end portion of the barrel, thereby firmly to support the cap member on the barrel, and the head end portion of the cap member telescopically receives a boss 52 on the head end portion 14 of the barrel. In the retracted position the cap, therefore, engages the boss 52, a part of the barrel adjacent the groove 26 and a portion of the tapered distal end 18 of the barrel, thereby rendering the pen substantially rigid (see FIG. 5).

In being moved between the extended and retracted positions, the cap member moves freely over most of the extent of movement by reason of a sliding or clearance fit between the rib 48 on the cap member and the reduced diameter part of the tip end portion of the barrel. In the extended position of the cap member (see FIG. 6), the rib 48 bears against the shoulder 25*a* which, because of its larger outer diameter (see FIGS. 1 and 2) keeps the cap member from being removed entirely from the barrel. In the extended position, moreover, the cap member no longer covers the flexible portion 16, so the pen can bend along the flexible portion in the manner described above and shown in FIG. 6. (The pen can be bent considerably more than the amount shown in FIG. 6.)

The above-described embodiment of the invention is intended to be merely exemplary, and numerous variations and modifications will be apparent to those of ordinary skill in the art. For example, the means by which the cap member is retained in the extended and retracted positions can be modified, such as by having a rib on the barrel and grooves in the cap. The length of the cap member can be such that it is only sufficiently longer than the flexible portion of the barrel to provide a substantially rigid coupling with the tip end portion and the head end portion so that the pen is substantially rigid when the cap member is in the retracted position for use. The writing tip is not necessarily limited to ball-point cartridges, although the type of writing tip used in the pen should be chosen with due attention to the shelf life for a particular type of packaging (hermetically-sealed packages can make shelf life largely immaterial) and the useful life of the writing tip, inasmuch as the cap member of the pen does not fully enclose the writing tip. In the circumstances ball-point cartridges are preferred over the so-called felt-tip cartridges, which dry out when uncovered.

Thus, there is provided in accordance with the invention a pen that is inexpensive to manufacture and convenient to carry and use. The cap is securely retained on the barrel and is not removed when the pen is used, so it cannot be lost. The cap covers the tip when the pen is stored or transported, and the pen is flexible and, therefore, can be bent to fit more readily into pockets and small purses.

I claim:

1. A pen comprising an elongated one-piece barrel having substantially rigid tip end and head end portions joined to each other by an intermediate integral flexible portion, whereby the barrel can be bent at the flexible portion, a writing tip at the distal end of the tip end portion, a substantially rigid tubular cap member telescopically received over the tip end portion of the barrel and movable along the barrel between (1) a retracted position in which it overlies part of the tip end portion and substantially all of the flexible portion, and thus leaving the writing tip exposed and rendering the pen substantially rigid, and (2) an extended position in which it covers the writing tip and leaves the flexible portion exposed, thus protecting the writing tip and rendering the pen flexible, and means for releasably retaining the cap member in each of the retracted and extended positions.

2. A pen according to claim 1 wherein the cap member has a length such that it covers a major part of the barrel when in the retracted position, the pen being thereby adapted to be held for use by gripping the cap member.

3. A pen according to claim 2 wherein an external circumferential surface of the tip end portion of the barrel closely adjacent the writing tip engages a matching internal surface of the cap member in the retracted position of the cap member, whereby the tip end portion is firmly supported within the cap member when the pen is in use.

4. A pen according to claim 1 wherein the retaining means includes longitudinally spaced-apart external circumferential grooves in the tip portion of the barrel and an internal circumferential rib on the cap member receivable in the respective grooves.

5. A pen according to claim 4 wherein the groove in the barrel that is nearer the writing tip is bounded on its side nearer the writing tip by a retaining shoulder that engages the rib on the cap member, whereby detachment of the cap member from the barrel is impeded.

6. A pen according to claim 4 wherein a substantial part of the external surface of the tip end portion of the barrel between the grooves makes a sliding or clearance fit with the rib on the cap member, whereby the cap member slides easily between the extended and retracted positions.

7. A pen according to claim 1 wherein the end of the cap member that is nearer to the head end portion telescopically receives a part of the head end portion in the retracted position, thereby to restrict bending of the head end portion relative to the flexible portion.

8. A pen according to claim 1 wherein the head end portion of the barrel includes an integral pocket clip.

9. A pen according to claim 8 wherein the pocket clip is joined to the head end portion by an integral flexible hinge strip spaced apart from both ends of the clip, whereby the hinge strip constitutes a fulcrum, and wherein the distal end of the head portion of the barrel receives a resilient insert having a portion engaging the pocket clip and resiliently urging the clip to pivot about the fulcrum to a closed position, the insert being yieldable to enable the clip to pivot about the fulcrum to an open position.

10. A pen according to claim 1 wherein the flexible portion of the barrel comprises at least one bendable strip extending longitudinally between and joined to the tip end and head end portions and a multiplicity of longitudinally spaced-apart ribs extending transversely from the strip at least in each direction of bending of the strip, the adjacent pairs of ribs being engageable upon bending of the strip and limiting the amount of bending of each segment of the strip between adjacent ribs.

11. A pen according to claim 10 wherein there are two bendable strips located opposite each other adjacent the outer transverse extremity of the barrel and wherein the ribs are segments of rings that join the two strips transversely.

* * * * *